US008776846B1

(12) United States Patent
Thompson et al.

(10) Patent No.: US 8,776,846 B1
(45) Date of Patent: Jul. 15, 2014

(54) WALLET CARD RETRIEVAL SLIP

(76) Inventors: Melanie Thompson, Germantown, TN (US); Susan Black, Germantown, TN (US)

( * ) Notice: Subject to any disclaimer, the term of this patent is extended or adjusted under 35 U.S.C. 154(b) by 468 days.

(21) Appl. No.: 13/299,527

(22) Filed: Nov. 18, 2011

(51) Int. Cl.
*A45C 1/06* (2006.01)

(52) U.S. Cl.
USPC ..... 150/147; 150/138; 206/39.5

(58) Field of Classification Search
USPC ..... 150/134, 138–141, 132; 40/359; 229/67.1
See application file for complete search history.

(56) References Cited

U.S. PATENT DOCUMENTS

| | | | | | |
|---|---|---|---|---|---|
| 1,336,584 | A * | 4/1920 | Ringer | 40/380 |
| 1,670,343 | A * | 5/1928 | Clemens | 206/39.5 |
| 3,068,923 | A * | 12/1962 | Wolf | 150/138 |
| 3,999,701 | A * | 12/1976 | Ward | 229/87.01 |
| 4,141,400 | A | 2/1979 | Mangan | |
| 4,711,347 | A | 12/1987 | Drexler et al. | |
| 5,159,964 | A * | 11/1992 | Baker et al. | 150/147 |
| 5,203,457 | A * | 4/1993 | Garcia | 206/499 |
| 5,713,406 | A * | 2/1998 | Drury | 150/132 |
| 5,941,375 | A | 8/1999 | Kamens et al. | |
| 6,105,298 | A * | 8/2000 | Grayson et al. | 40/776 |
| 6,808,104 | B2 * | 10/2004 | Cobble | 229/67.1 |
| 6,845,863 | B1 | 1/2005 | Riley | |
| D651,239 | S * | 12/2011 | Kendall | D19/26 |
| 8,152,050 | B2 * | 4/2012 | Busam et al. | 229/67.1 |
| D691,195 | S * | 10/2013 | Klosky | D19/26 |
| 8,567,460 | B1 * | 10/2013 | Lentsch | 150/147 |
| 2005/0000839 | A1 * | 1/2005 | Densley | 206/425 |
| 2009/0065111 | A1 * | 3/2009 | Ohayon et al. | 150/147 |
| 2011/0186195 | A1 * | 8/2011 | Cohen | 150/139 |
| 2013/0036637 | A1 * | 2/2013 | Mazursky | 40/359 |

* cited by examiner

*Primary Examiner* — Tri Mai
(74) *Attorney, Agent, or Firm* — Crossley Patent Law; Micah C. Gunn

(57) ABSTRACT

A wallet card retrieval slip that includes a sleeve having a transparent top sheet and a transparent bottom sheet conjoined at a back edge and a second edge, the sleeve having a vertical pull tab disposed on a first edge proximal the back edge and a horizontal pull tab disposed on a front edge proximal the second edge, wherein a card is removably insertable into the sleeve and easily retrieved from a wallet pocket by means of the vertical and horizontal pull tabs. An alternative embodiment has the vertical pull tab centrally disposed on the first edge to enable a staggered arrangement of vertical pull tabs on a plurality of sleeves when used with a plurality of cards in adjacent pockets in a wallet.

8 Claims, 4 Drawing Sheets

WALLET CARD RETRIEVAL SLIP

BACKGROUND OF THE INVENTION

Various types of card protection sleeves are known in the prior art. However, what is needed is a wallet card retrieval slip that includes a vertical pull tab and a horiztonal pull tab for easy retrieval of a card from a wallet pocket.

FIELD OF THE INVENTION

The present invention relates to a wallet card retrieval slip, and more particularly, to a wallet card retrieval slip that includes a vertical pull tab and a horiztonal pull tab for easy retrieval of a card from a wallet pocket.

SUMMARY OF THE INVENTION

The general purpose of the wallet card retrieval slip, described subsequently in greater detail, is to provide a wallet card retrieval slip which has many novel features that result in a wallet card retrieval slip which is not anticipated, rendered obvious, suggested, or even implied by prior art, either alone or in combination thereof.

Many coverings and sleeves devised to protect the magnetic strips of credit cards, and other cards useable for various transactions in the modern world, are seen in the prior art. But what is needed is a wallet card retrieval slip that makes it easy for a user to retrieve a credit card, or other card, from a wallet pocket without the need of gaining purchase on the card itself. It is often difficult to retrieve cards from a wallet, a required prestidigitation and dexterity often yet more difficult for elderly people. The present device, therefore, while also offering protection to a card, includes a vertical pull tab and a horizontal pull tab disposed on a sleeve to enable ready and easy retrieval of a card from a wallet pocket.

The present wallet card retrieval slip includes a sleeve having a top sheet and an enantiomorphic bottom sheet. The bottom sheet is conjoined with the top sheet along a back edge and a second edge. A front edge and a first edge are therefore open, and a card may be removably inserted into the sleeve between the top sheet and the bottom sheet, and removably secured therein by means of the closed back edge and the closed second edge.

The sleeve protects the card magnetic strip and markings, such as the security code on present day credit cards, while also making retrieval of the card simple and easy without the need of gaining purchase on the card itself. To accomplish this, the present wallet card retrieval slip includes the vertical pull tab and the horizontal pull tab.

The vertical pull tab is disposed on the first edge proximal to the back edge. The horizontal pull tab is disposed on the front edge proximal to the second edge. When placed in a wallet pocket, the vertical pull tab and alternately the horizontal pull tab are configured to protrude from the pocket enabling a user to retrieve the card in the sleeve by simply pulling the vertical pull tab or alternately the horizontal pull tab, as needed. The sleeve thusly slides out from the pocket, and the card therein is presented for use without the need of garnering purchase on the card itself.

The present wallet card retrieval slip is intended to be customizable for use in both vertically aligned and horizontally aligned pockets typical of most wallets. For use in a horizontally aligned pocket, the vertical pull tab may be cut off with a pair of scissors, as preferred. Likewise, the horizontal tab may, if desired, be similarly cut off by the pair of scissors.

The present wallet card retrieval slip has an alternative embodiment with the vertical pull tab centrally disposed on the first edge. When used with multiple cards in a wallet, as devised, it is envisioned that each card will be placed in a wallet card retrieval slip; and cards placed in adjacent pockets within a wallet will be more easily accessible by using the alternative embodiment sequentially relative to cards in sleeves with the vertical pull tab disposed proximal the back edge, such that the vertical pull tabs of each sleeve for each card will be disposed in a staggered arrangement within the wallet to enable easy retrieval of each card relative adjacent cards, as desired.

The present wallet card retrieval slip also includes a thumb cut-out disposed between the first edge and the front edge. This thumb cut-out enables easy removal of a card from the sleeve as the card placed within the sleeve presents a corner protruding from the thumb cut-out, which corner may be readily contacted between a finger and thumb to simply pull the card from within the sleeve for use.

It is envisioned that the top sheet and the bottom sheet will be transparent, or translucent, such that a card disposed within the sleeve will be visible and identifiable to a person using the wallet card retrieval slip without the need of removing the card from the sleeve to identify it.

Thus has been broadly outlined the more important features of the present wallet card retrieval slip so that the detailed description thereof that follows may be better understood and in order that the present contribution to the art may be better appreciated.

Objects of the present wallet card retrieval slip, along with various novel features that characterize the invention are particularly pointed out in the claims forming a part of this disclosure. For better understanding of the wallet card retrieval slip, its operating advantages and specific objects attained by its uses, refer to the accompanying drawings and description.

BRIEF DESCRIPTION OF THE DRAWINGS FIGURES

DETAILED DESCRIPTION OF THE DRAWINGS

With reference now to the drawings, and in particular FIGS. 1 through 5 thereof, example of the instant wallet card retrieval slip employing the principles and concepts of the present wallet card retrieval slip and generally designated by the reference number 10 will be described.

Referring to FIGS. 1 through 5 a preferred embodiment of the present wallet card retrieval slip 10 is illustrated.

Figure 1:
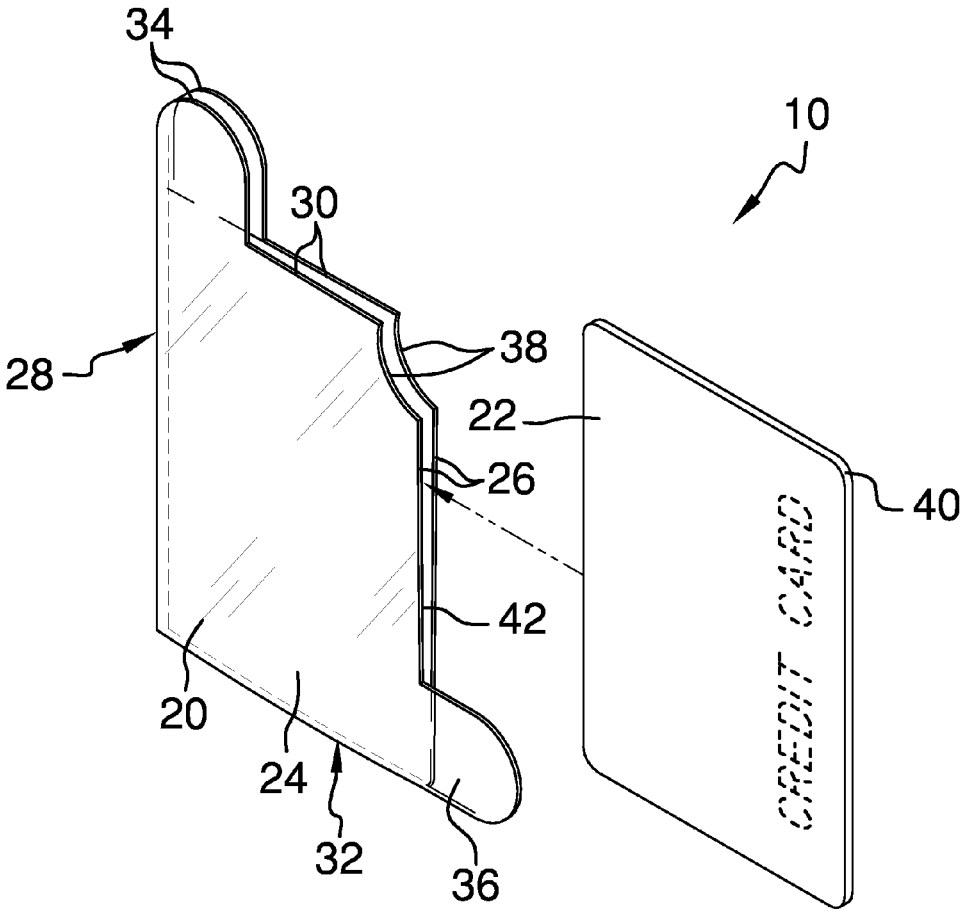
FIG. 1 is an exploded view.
Figure 2:
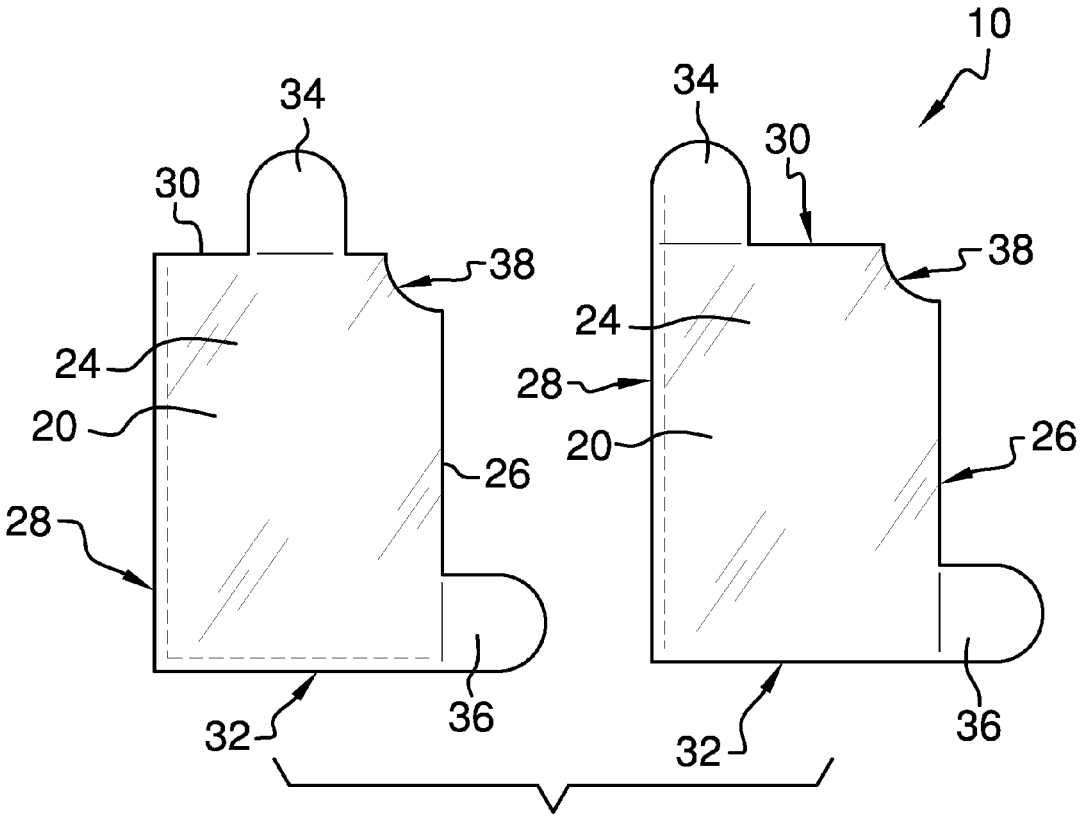
FIG. 2 is a top view.
Figure 3:
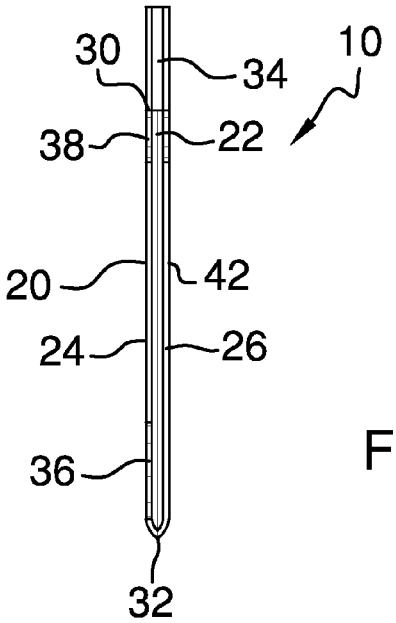
FIG. 3 is a front view.
Figure 4:
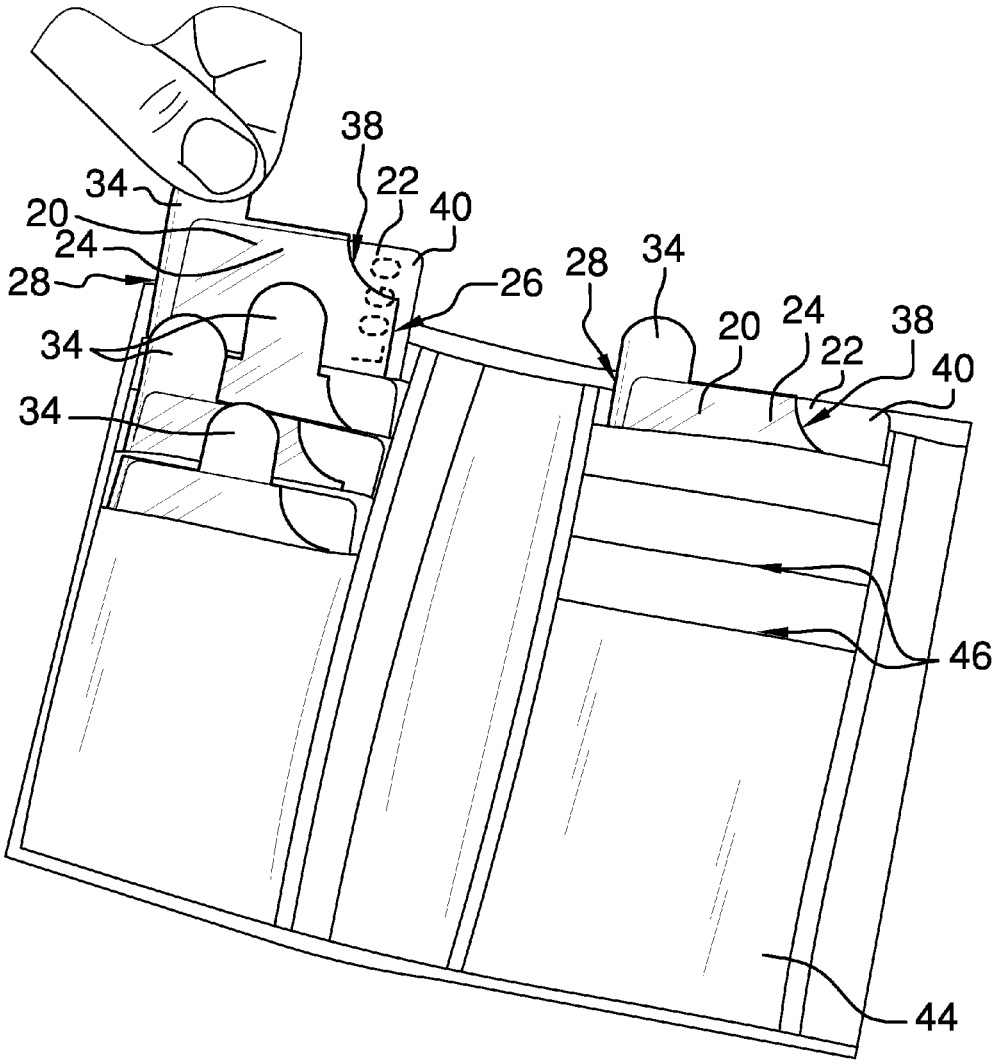
FIG. 4 is an in-use view detailing the retrieval of a credit card from a wallet.
Figure 5:
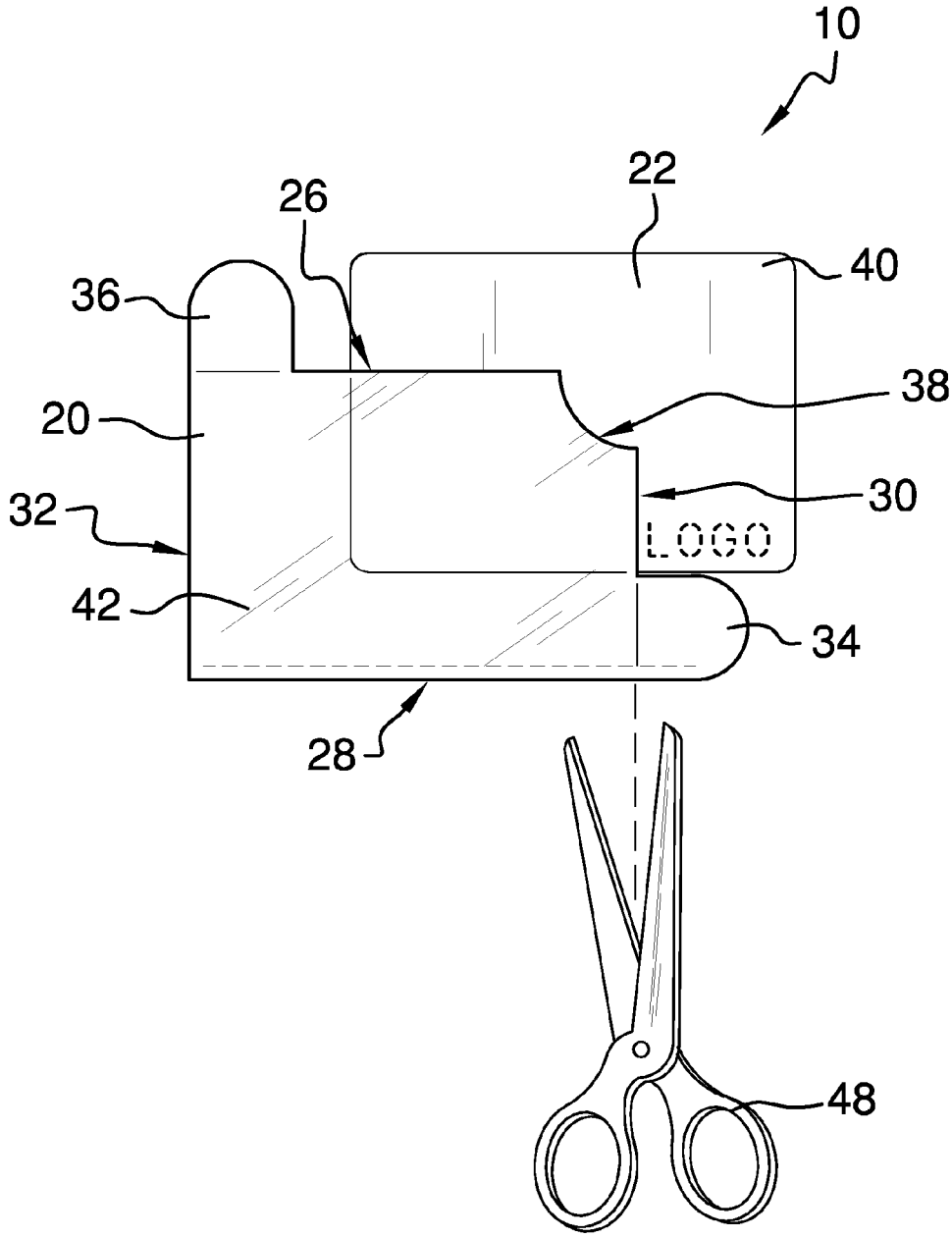
FIG. 5 is an in use view detailing the removal of a vertical pull tab.

The wallet card retrieval slip 10 includes a polymeric sleeve 20 configured to removably receive a credit card 22. The polymeric sleeve 20 includes a top sheet 24. The top sheet 24 has a front edge 26, a back edge 28, a first edge 30, and a second edge 32. A vertical pull tab 34 is disposed on the first edge 30 proximal to the back edge 28. A horizontal pull tab 36 is disposed on the front edge 26 proximal to the second edge 32. An alternative embodiment of the present wallet card retrieval slip 10 is illustrated in FIG. 2, wherein the vertical pull tab 34 is centrally disposed upon the first edge 30. The importance of this alternate placement will be discussed below.

A thumb cut-out 38 is disposed between the first edge 30 and the front edge 26. This thumb cut-out 38 enables easy retrieval of a credit card 22 placed in the sleeve 20, the credit card 22 having a corner 40 protruding therefrom when said credit card 22 is inserted into the sleeve 20.

A bottom sheet 42 is enantiomorphic with respect to the top sheet 24. The bottom sheet 42 is attached to the top sheet 24 along the back edge 28 and the second edge 32. Thusly, the credit card 22 is insertable into the sleeve 20 between the top sheet 24 and the bottom sheet 42 along the front edge 26 and the first edge 30. The credit card 22 is held within the sleeve 20 abutting the back edge 28 and the second edge 32, which back edge 28 and second edge 32 are closed between the top sheet 24 and the bottom sheet 42. When placed in the sleeve 20, the credit card 22 presents a corner 40 protruding from the thumb cut-out 38.

When placed in the sleeve 20, the credit card 22 is then inserted into an extant wallet 44 pocket 46. When placed in the pocket 46, the vertical pull tab 34 and alternately the horizontal pull tab 36 protrude from the pocket 46 enabling a person to gain purchase on the sleeve 20 to pull the credit card 22 from within the pocket 46 for use, as desired (see FIG. 4).

A credit card 22 is therefore removably insertable into the wallet card retrieval slip 10 between the top sheet 24 and the bottom sheet 42 through the front edge 26 and the first edge 30, and the credit card 22 is easily retrievable from a wallet 44 by means of the vertical pull tab 34 and alternately the horizontal pull tab 36. The present wallet card retrieval slip 10 is configured to be used with multiple credit cards 22 (see FIG. 4). For ease of use, it is envisioned that a sleeve 20 having the vertical pull tab 34 disposed on the first edge 30 proximal the back edge 28 will be used adjacent a sleeve 20 having the vertical pull tab 34 centrally disposed upon the first edge 30, thereby presenting a staggered arrangement of vertical pull tabs 34 for ease of retrieving a particular card 22 from a wallet 44 (see FIG. 4).

The present wallet card retrieval slip 10 is envisioned to be customizable for use with a wallet 44 wherein the pockets are horizontally aligned and alternately a wallet 44 with pockets that are vertically aligned. The vertical pull tab 34 and alternately the horizontal pull tab 36 may be cut off with an extant pair of scissors 48 to fit the wallet card retrieval slip 10 to either style of pocket 46 in a wallet 44 (see FIG. 5). The wallet card retrieval slip 10 is therefore easily removed from a wallet 44 pocket 46 when needed without the difficulty of necessarily gaining purchase on the credit card 22 itself. A person simply pulls on the vertical 34 and alternately horizontal 36 pull tab to easily lift the credit card 22 from the pocket 46. The credit card 22 may then be easily removed from the sleeve 20 by the corner 40 for use, as desired, and easily returned to the sleeve 20 and thence to the wallet 44 pocket 46.

The top sheet 24 and the bottom sheet 42 are envisioned to be transparent or translucent in order to enable a user to see and identify the credit card 22 therein disposed. It should be realized that use of the present wallet card retrieval slip 10 is not restricted for use with credit cards 22 only, but is envisoned for use with other cards suitable for storage and portage in a wallet 44, such cards including, but not restricted to, library cards, membership cards, pre-paid phone cards, debit cards, and other cards, as desired.

What is claimed is:

1. A wallet card retrieval slip comprising:

a polymeric sleeve configured to removably receive a credit card, the sleeve comprising:

a top sheet comprising:

a front edge;

a back edge;

a first edge;

a second edge;

a vertical pull tab disposed on the first edge proximal to the back edge;

a horizontal pull tab disposed on the front edge proximal to the second edge;

a thumb cut-out disposed between the first edge and the front edge;

a bottom sheet, enantiomorphic with respect to the top sheet, the bottom sheet attached to the top sheet along the back edge and the second edge;

wherein a credit card is removably insertable into the wallet card retrieval slip between the top sheet and the bottom sheet through the front edge and the first edge, whereby said credit card is easily retrievable from a wallet by means of the vertical pull tab and alternately the horizontal pull tab.

2. The wallet card retrieval slip of claim 1 wherein the vertical pull tab is centrally disposed on the first edge.

3. The wallet card retrieval slip of claim 1 wherein the vertical pull tab and alternately the horizontal pull tab are cut off with an extant pair of scissors to fit the wallet card retrieval slip to a pocket in a wallet.

4. The wallet card retrieval slip of claim 1 wherein the credit card presents a corner for easy retrieval at the thumb cut-out.

5. The wallet card retrieval slip of claim 2 wherein the credit card presents a corner for easy retrieval at the thumb cut-out.

6. The wallet card retrieval slip of claim 2 wherein the top sheet and the bottom sheet are transparent.

7. The wallet card retrieval slip of claim 2 wherein the vertical pull tab and alternately the horizontal pull tab are cut off with an extant pair of scissors to fit the wallet card retrieval slip to a pocket in a wallet.

8. The wallet card retrieval slip of claim 3 wherein the top sheet and the bottom sheet are translucent.

* * * * *